United States Patent [19]

Toshio

[11] 4,394,839

[45] Jul. 26, 1983

[54] COMBUSTION APPARATUS

[76] Inventor: Ikeda Toshio, 12-19, 6 chome, Chiyoda, Sagamihara, Kanagawa, Japan

[21] Appl. No.: 265,596

[22] Filed: May 20, 1981

[30] Foreign Application Priority Data

Oct. 16, 1980 [JP] Japan ..... 55-143629

[51] Int. Cl.[3] ..... F23B 7/00

[52] U.S. Cl. ..... 110/234; 110/211; 122/17; 122/18

[58] Field of Search ..... 110/233, 234, 210, 211, 110/244; 122/13 R, 16–18

[56] References Cited

U.S. PATENT DOCUMENTS

| | | | |
|---|---|---|---|
| 377,551 | 2/1888 | Emerson | 110/234 |
| 393,579 | 11/1888 | Palmer | 110/234 |
| 1,237,737 | 8/1917 | Albert | 122/18 |
| 2,860,917 | 11/1958 | Thompson | 122/17 |
| 2,929,342 | 3/1960 | Young | 110/211 |
| 3,658,017 | 4/1972 | Dibelius et al. | 110/244 |
| 4,089,278 | 5/1978 | Brandt | 110/234 |
| 4,312,278 | 1/1982 | Smith et al. | 110/234 |

*Primary Examiner*—Henry C. Yuen

*Attorney, Agent, or Firm*—Birch, Stewart, Kolasch and Birch

[57] ABSTRACT

A combustion apparatus and a process used to obtain hot water without producing any pollution therefrom, including a hermetic casing, a furnace and cyclone device, all of which are disposed in the hermetic casing. The furnace being designed to combust a waste material and the exhaust gases including dust being introduced into the cyclone device to eliminate the dust. The hot water is obtained by surrounding the furnace and cyclone device with a space including water which contacts directly to the heated walls thereof.

7 Claims, 13 Drawing Figures

COMBUSTION APPARATUS

FIELD OF THE INVENTION

This invention relates to a combustion apparatus and a process thereof and more particularly to a combustion apparatus and a process which is able to produce hot water continuously by burning waste materials therein while preventing air pollution from occuring during the operation.

DESCRIPTION OF THE PRIOR ART

In the conventional furnace for waste materials, a kind of boiler is provided therewith in order to obtain hot water by making use of the heat which occurs within the furnace. However, this kind of conventional furnace has mainly been designed to combust waste materials, it does not provide an arrangement to prevent air pollution from occurring. Thus, dust is exhausted into the air during the operation and dust materials will accumulate within the furnace so as to interfere with the combustion of the waste materials. As a result of the above fact, the conventional boiler will not be able to supply sufficient hot water in a predetermined quantity. Also, there is another disadvantage in that the furnace and the boiler occupy a very large space since both of them are separately disposed from each other so as to be difficult to be placed in a narrow space.

SUMMARY AND OBJECTS OF THE PRESENT INVENTION

It is a principal object of the present invention to provide an improved combustion apparatus which can obtain hot water continuously by way of burning waste materials while preventing air pollution from occuring.

It is another object of the present invention to provide an improved combustion apparatus which comprises a hermetic casing, a cylindrical furnace disposed therein and a cyclone device, said cylindrical furnace and cyclone device being surrounded with water within said casing so as to continuously obtain hot water from said combustion apparatus while preventing air pollution from occurring after combustion of waste materials.

It is further object of the present invention to provide an improved combustion apparatus comprising a hermetic casing including a furnace and a cyclone device operatively disposed therein with a space being provided therebetween, the furnace is in communication with said cyclone device through a passage, the hermetic casing includes an inlet port for supplying fluid to said space and an outlet port for discharging fluid from said space, the furnace includes a firing port and a fire hole for supplying materials and an ashes hole for removing ashes all of which extend out of said hermetic casing, an exhaust pipe is operatively positioned to extend through the top portion of said hermetic casing and a fire grate is disposed adjacent a bottom portion of said furnace, a blower is operatively connected with the exhaust pipe and the fire grate to supply air to the furnace, the cyclone device includes an ashes hole for removing ashes at the bottom portion thereof which extends out of said hermetic casing and thereby is able to obtain hot water from said combustion apparatus while preventing air pollution from occurring after combustion of waste materials.

It is still a further object of the present invention to provide an improved combustion process which comprises the steps of:

(a) supplying waste material to a furnace;
(b) firing said waste material;
(c) supplying air into said furnace from both a top and a bottom direction in said furnace;
(d) introducing heated air including dust particles into a cyclone device;
(e) eliminating said dust particles from said heated air under a function of said cyclone device.

BRIEF DESCRIPTIONS OF THE DRAWINGS

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
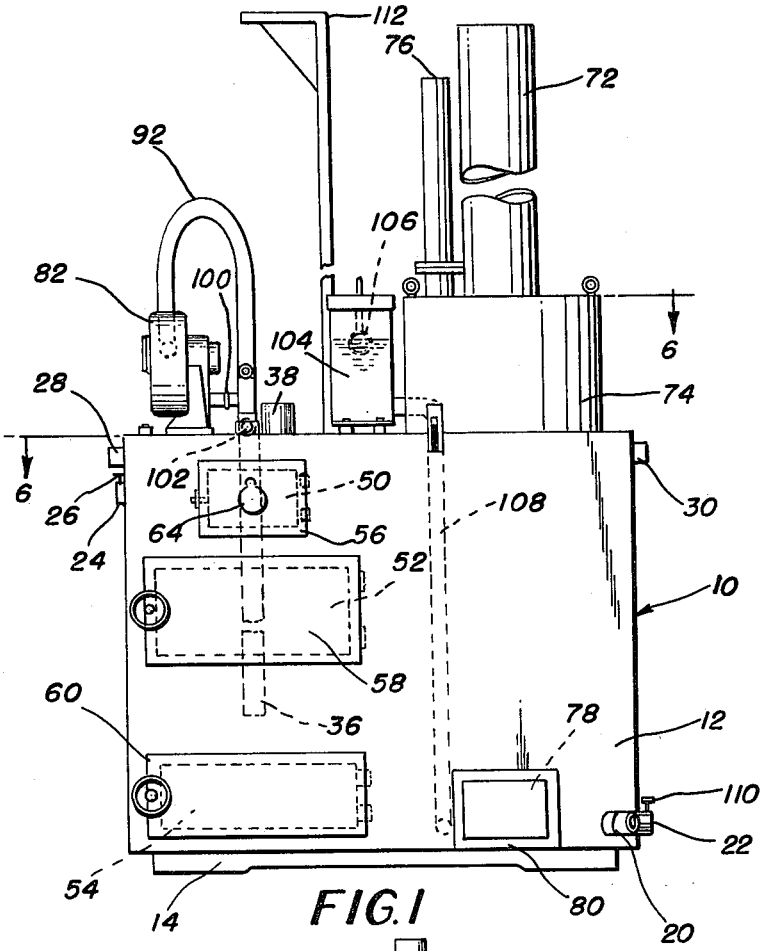
FIG. 1 is a front view illustrating a combustion apparatus relating to the present invention.

As illustrated in FIG. 1, a combustion apparatus 10 is designed to produce hot water according to the process of the present invention. The combustion apparatus 10 includes a hermetic casing 12 provided on a ellipsoid base 14, a cylindrical furnace 16 for waste materials disposed within the casing 12 and a cyclone device 18 for eliminating dust also disposed within the casing 12.

Figure 7:
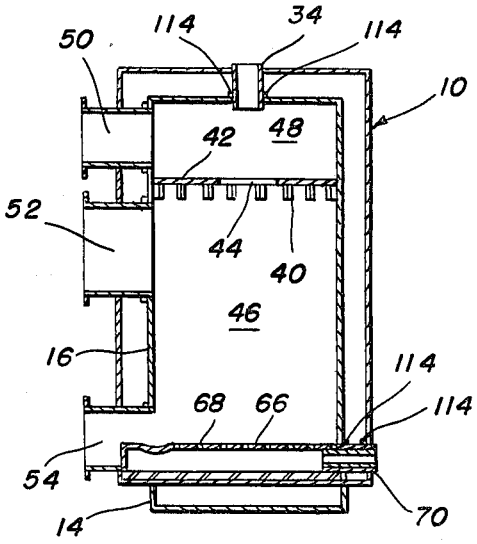
FIG. 7 is a longitudinal sectional view of the combustion apparatus along the line 7—7 in FIG. 6 in accordance with this invention.
Figure 6:
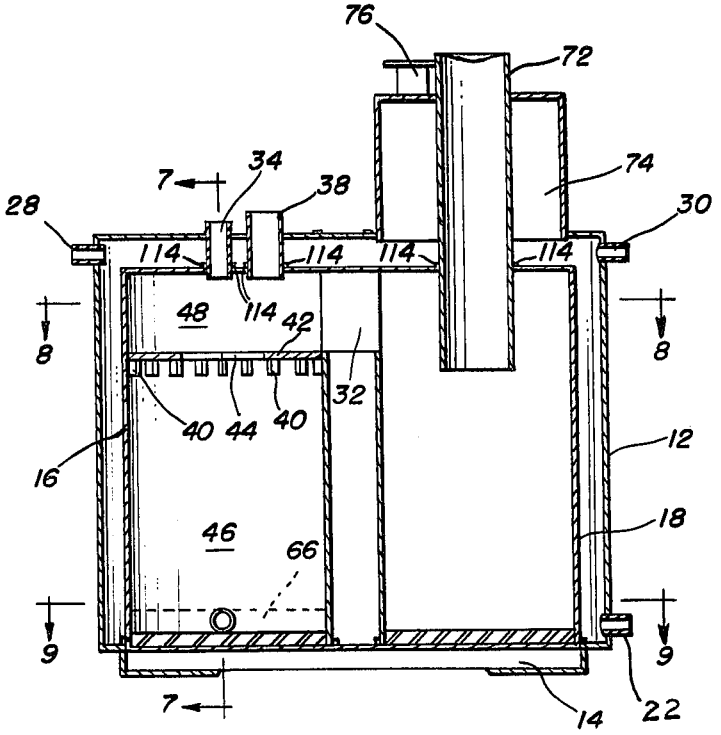
FIG. 6 is a longitudinal sectional view of the combustion apparatus along the line 6—6 of FIG. 1.

As illustrated in FIGS. 6 and 7, a space is provided between the hermetic casing 12, the furnace 16 and the cyclone device 18 in which water is positioned to surround the various elements. The casing 12 includes a drain pipe 20 at the bottom portion thereof adjacent to an inlet port 22 which is used to introduce water into the system. An inlet port 24 is positioned in the side wall of the upper portion thereof through the furnace 16 for supplying waste oil when it is necessary to add a more combustible fuel to the furnace 16 to combust the waste material. The inlet port 24 is closed with a valve 26 during normal operation. Two outlet ports 28 and 30 for hot water are provided in the casing 12 and are positioned at opposite top portions from each other.

The casing 12 is constructed of metal plate such as iron or stainless steel having an arrangement to prevent water from leaking therefrom since liquid, namely water, circulates within the space formed in part by the casing 12. Some suitable adiabatic materials (not shown) shall be disposed onto the inside and/or outside wall surfaces of the casing 12 which acts as a lining or coating.

Figure 8:
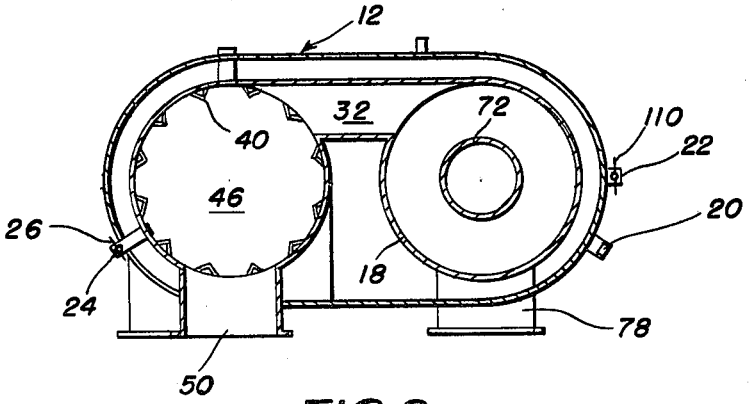
FIG. 8 is a cross-sectional view of the combustion apparatus along the line 8—8 shown in FIG. 6.
Figure 9:
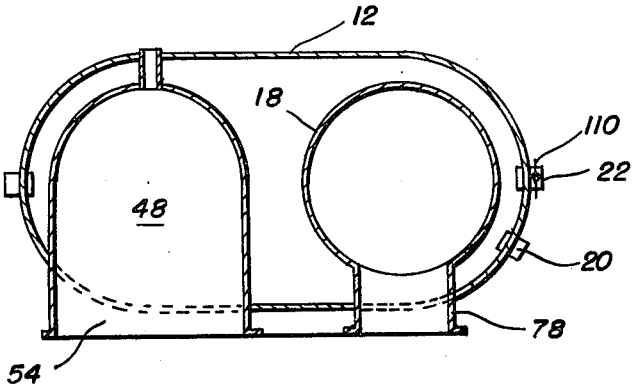
FIG. 9 is a cross-sectional view of the combustion apparatus along the line 9—9 shown in FIG. 6.

The furnace 16 is in communication with the cyclone device 18 at the upper portion thereof through a passage 32 which extends in a tangent direction from the furnace 16 to the cyclone device 18 (as shown in FIG. 8).

The furnace 16 includes a pipe member 34 disposed at the center of the top portion thereof on which an exhaust pipe 36 may be mounted. One end of the pipe member 34 extends out of the casing 12 while the other end extends into the casing 12. Another pipe member 38 is provided which is disposed at an eccentric location from the exhaust pipe 36 on the furnace 16 to reduce the pressure therein during an emergency and is closed by a conventional valve or other device (not shown) during normal operation.

Figure 2:
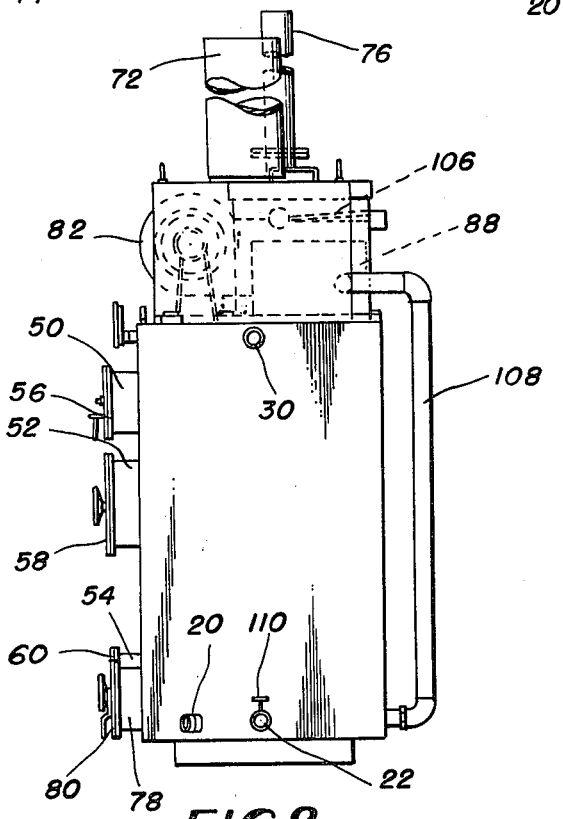
FIG. 2 is a right side view illustrating the combustion apparatus shown in FIG. 1.

Projections 40 are positioned to extend within the furnace 16 at a location under the inlet port 24 so as to support plates 42 thereon. Each plate 42 includes a half-rounded shape so that when the plates 42 are positioned adjacent to each other they form a hole 44 at the center thereof. A first combustion chamber 46 is defined between the plates 42 and the bottom wall of the furnace 16 which is in communication with a second combustion chamber 48 through the hole 44. The second combustion chamber 48 is defined between the plates 42 and the top wall of the furnace 16. A firing port 50, a fire hole 52 for waste materials and an ashes hole 54 are provided in a front wall of the furnace 16 as illustrated in FIGS. 1, 2 and 7. The firing port 50, the fire hole 52 and the ashes hole 54 are closed by covers 56, 58 and 60, respectively, during normal operating conditions. A round shaped window 62 normally closed with a cover 64, is provided within the cover 56 to check the fire condition within the furnace 16.

Figure 11:
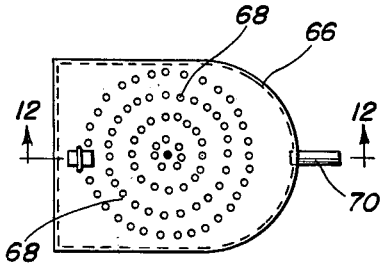
FIG. 11 is a plan view of the fire grate in accordance with the present invention.
Figure 12:
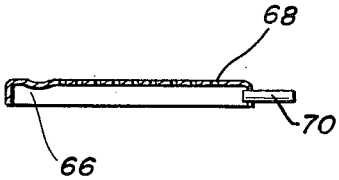
FIG. 12 is a longitudinal sectional view of the fire grate shown in FIG. 11.
Figure 13:
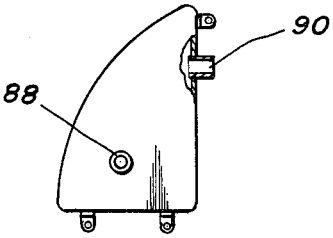
FIG. 13 is a plan view of the air chamber, a part of which is shown in a partial sectional view.

At the bottom portion in the furnace 16 there is disposed a fire grate 66 which is hollow and in the shape of a half-divided ellipse including a plurality of small holes 68 having a diameter of approximately 4 mm on the upper plate surface thereof as shown in FIGS. 11 and 12. A pipe 70 is connected to a blower, as mentioned hereinbelow, and is secured to the fire grate 66 to introduce air into the furnace 16 through the holes 68.

A chimney 72 is disposed at the center of the top portion of the cyclone device 18 and includes a first end which extends into the cyclone device 18 and a second end which extends out through the hot water tank 74 which is provided on the top portion of the casing 12 as shown in FIGS. 1, 2 and 6. At the top portion of the hot water tank 74 is provided an exhaust pipe 76 to exhaust air and water vapor from the heated water positioned within the casing 12 during operation of the furnace. An ashes hole 78 is provided at the bottom portion of the cyclone device 18 so as to provide an entrance for removing ashes produced by the waste materials. A cover 80 is attached to the casing 12 to normally close the ashes hole 78.

Figure 3:
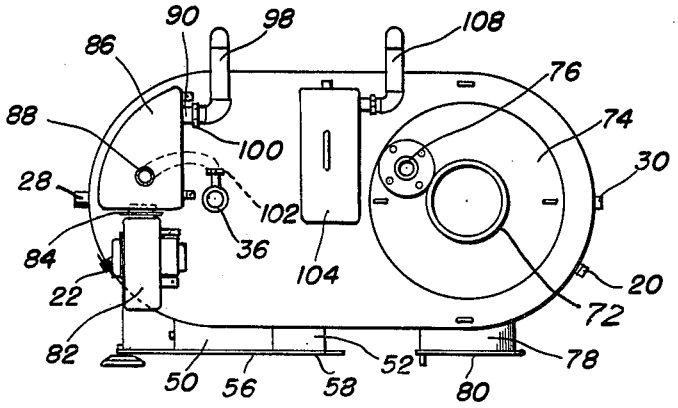
FIG. 3 is a plan view of the combustion apparatus shown in FIGS. 1 and 2.
Figure 4:
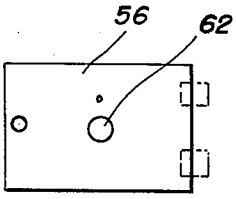
FIG. 4 is an enlarged front view of a cover closing a firing port provided with a furnace in accordance with the present invention.
Figure 5:
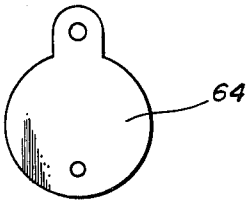
FIG. 5 is an enlarged front view of a cover for closing a a window provided in the cover shown in FIG. 4.
Figure 10:
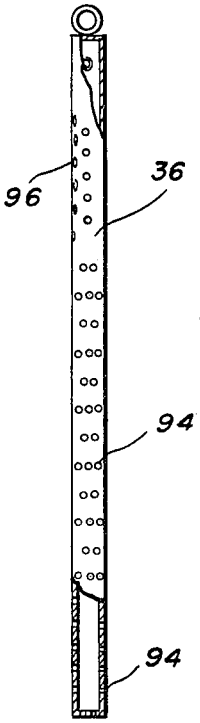
FIG. 10 is a front view of the exhaust pipe of which a top portion and a bottom portion are shown in a partial sectional view.

As illustrated in FIG. 3, the casing 12 includes a blower 82 secured on the top portion thereof including an outlet 84 which is connected to an air chamber 86. The air chamber 86 receives air from the blower 82 to accumulate and exhaust it under a certain predetermined pressure. The air chamber 86 includes two outlets, a first outlet 88 is positioned on the upper portion of the air chamber 86 and a second outlet 90 is positioned on the side portion thereof. The first outlet 88 is connected through a flexible tube 92 to one end of the exhaust pipe 36. As illustrated in FIG. 10, the exhaust pipe 36 includes a plurality of holes 94 and 96. The holes 94 are provided radially on a portion of the pipe 36 which is between the bottom thereof and a portion corresponding to below the plates 42 whereas the holes 96 are only provided on a portion of the pipe 36 which faces towards the cyclone device 18 through the passage 32. The second outlet 90 is connected through the pipe 98 to the pipe 70 of the fire grate 66. Both the first outlet 88 and the second outlet 90 are controlled to be opened and closed by means of conventional valve means 100 and 102, respectively.

As illustrated in FIGS. 1 and 3, an indicator tank 104 containing a floating member 106 therein is secured between the hot water tank 74 and air chamber 86 on the casing 12. The indicator tank 104 is in communication with the space within the hermetic casing 12 through a pipe 108 so that the floating member 106 floats up and down corresponding to the water level within the space in the casing 12. The floating member 106 is operatively connected for example, electrically, with a valve 110 which is mounted on the water supplying pipe 22. A signal created by the floating member 106 can be utilized to open or close the valve 110 to control the quantity of the water which should be supplied into the space within the casing 12. A hanging support member 112 is also provided on the top portion of the casing 12 to which the exhaust pipe 36 may be connected to adjust a position thereof relative to the interior of the furnace 16 to optimize the combustion. As illustrated in FIGS. 6 and 7, sealing materials 114 are provided between the casing 12 and the furnace 16 and the cyclone device 18 to protect against water leakage due to expansion and contraction of the metal surfaces during operation.

Before starting the operation of the furnace an amount of water is introduced into the space in the casing 12 through the inlet port 22 until a predetermined level is supplied thereto. A flamable waste material, i.e. a used tire or a piece thereof, is positioned in the furnace 16 through the fire hole 52. Firing is conducted by conventional means by making use of the firing port 50. It is preferred to pour some drops of waste oil into the furnace 16 through the inlet port 24 to assist firing when using waste material which is not very flamable. Air is supplied into the furnace 16 by the exhaust pipe 36 and the fire grate 66 after the operation of the blower 82. It is only necessary to supply air through the exhaust pipe 36 or the fire grate 66 when supplying air to waste materials of superior flamability. After the firing operation the firing port 50 is closed by the cover 56 so that the condition of the combustion materials may be examined by way of opening the cover 56 or the cover 64. The heated air created in the first combustion chamber 46 rises upwardly to the second combustion chamber 48 so that the air heats the plates 42 and the second combustion chamber 48 will be kept at a higher temperature than that of the first combustion chamber 46. The dust included in the heated air will be heated to a higher temperature within the second combustion chamber 48. Thereafter, the heated air in the second combustion chamber 48 is introduced into the cyclone device 18 through the passage 32 with the assistance of the air which is exhausted out of the holes 96. The cyclone device 18 eliminates dust from the heated air to utilizing a well known technique so that only heated air rises up through the chimney 72 into the atmosphere whereas the dust will be accumulated on the bottom of the cyclone device 18. The dust on the bottom portion of the furnace 16 or cyclone device 18 may be taken out by way of opening the covers 60 or 80, respectively.

During this operation the water within the space surrounding the furnace 16 and the cyclone device 18 is gradually heated so as to rise upwardly under the principle of convection. The hot water tank 74 functions as a holding tank for the hot water until it is supplied out by way of the outlet ports 28 or 30. Bubbles and vapors produced by heating the water are exhausted into the atmosphere through the exhaust pipe 76 since they rise upwardly to the upper portion of the hot water tank 74.

According to the present invention the water in the hermetic casing 12 is operatively heated to become hot in a short time since the water can contact directly against the wall of the furnace 16, the cyclone device 18 and the passage 32 all of which are heated to a high temperature. Further, effective combustion is easily preformed by way of controlling the air supply through the exhaust pipe 36, the fire grate 66 and the blower 82. Also, air pollution is effectively prevented from occurring because of the eliminating of dust by the cyclone device 18.

This invention has been particularly shown and disclosed with reference to preferred embodiments thereof, it will be understood by those in the art that foregoing and other changes in form and details may be made therein without departing from the spirit and scope of the invention.

I claim:

1. A combustion apparatus comprising:

a hermetic casing including a furnace and a cyclone device operatively disposed therein with a space being provided therebetween;

said furnace being in communication with said cyclone device through a passage;

said hermetic casing having an inlet port for supplying fluid to said space and an outlet port for discharging fluid from said space;

said furnace including a firing port and a fire hole for supplying waste materials and an ashes hole for removing ashes all of which extend out of said hermetic casing;

an exhaust pipe being operatively positioned to extend through the top portion of said hermetic casing and a fire grate being disposed adjacent a bottom portion of said furnace;

a blower being operatively connected with said exhaust pipe and said fire grate to supply air to said furnace;

and said cyclone device including an ashes hole for removing ashes at the bottom portion thereof which extends out of said hermetic casing.

2. A combustion apparatus according to claim 1, wherein said furnace includes plural combustion chambers therein both of which are defined by a plate member disposed between the bottom portion and top portion of said furnace.

3. A combustion apparatus according to claim 1, wherein said exhaust pipe is connected with said blower by means of a flexible tube for adjusting the position of said exhaust pipe within said furnace.

4. A combustion apparatus according to claim 3, wherein said exhaust pipe includes holes provided radially at the lower portion thereof.

5. A combustion apparatus according to claim 3, wherein said exhaust pipe includes holes through a section of an upper portion thereof, said upper portion being adapted to be directed towards said passage to said cyclone device.

6. A combustion apparatus according to claim 1, 2, 3, 4 or 5, wherein a hot water tank is positioned on said hermetic casing and connected to a pipe connecting member for communicating said hot water tank with said space.

7. A combustion apparatus according to claim 1, 2, 3, 4, 5 or 6 therein an indicator tank containing a floating member therein is operatively connected to said hermetic casing and a pipe connecting member for communicating said indicator tank with said space in said hermetic casing.

* * * * *